US010077563B2

(12) United States Patent
Duranleau

(10) Patent No.: US 10,077,563 B2
(45) **Date of Patent: *Sep. 18, 2018**

(54) FRONT ADJUSTABLE WALL PANEL MOUNTING DEVICE

(71) Applicant: Acculign Holdings, Inc., Wilmington, DE (US)

(72) Inventor: Andre Duranleau, Portland, OR (US)

(73) Assignee: Acculign Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/897,148

(22) Filed: Feb. 14, 2018

(65) Prior Publication Data

US 2018/0171642 A1 Jun. 21, 2018

Related U.S. Application Data

(60) Continuation of application No. 15/795,016, filed on Oct. 26, 2017, now Pat. No. 9,915,074, which is a (Continued)

(51) Int. Cl.
*E04F 13/25* (2006.01)
*E04B 2/96* (2006.01)

(Continued)

(52) U.S. Cl.
CPC ..... *E04F 13/25* (2013.01); *E04B 1/40* (2013.01); *E04B 2/721* (2013.01); *E04B 2/965* (2013.01);

(Continued)

(58) Field of Classification Search
CPC . E04F 13/23; E04F 13/08; E04F 13/25; E04F 13/083; E04B 2/721; E04B 1/40
See application file for complete search history.

(56) References Cited

U.S. PATENT DOCUMENTS 2,910,121 A 10/1959 Stern et al.
5,158,392 A * 10/1992 Takeda ..... E04B 2/34 403/315

(Continued)

FOREIGN PATENT DOCUMENTS

CN 101878341 A 11/2010
CN 201762935 U 3/2011

(Continued)

OTHER PUBLICATIONS

Korean Intellectual Property Office, International Search Report from PCT/US2013/057021, dated Dec. 6, 2013, which is an international application of Applicant Acculign Holdings, Inc. that shares the same priority as this U.S. application.

(Continued)

*Primary Examiner* — Paola Agudelo
(74) *Attorney, Agent, or Firm* — Kolisch Hartwell, P.C.

(57) ABSTRACT

A front adjustable wall panel mounting device that is adjustable from the front of a wall is disclosed. The front adjustable wall panel mounting device has a fixed channel configured to be coupled with a wall frame and a moving channel configured to be coupled with wall panel mounting hardware. The tilt, depth and vertical height of the wall panel can all be adjusted while the wall panel remains mounted to the wall frame.

20 Claims, 7 Drawing Sheets

Related U.S. Application Data continuation of application No. 15/437,156, filed on Feb. 20, 2017, now Pat. No. 9,803,373, which is a continuation of application No. 15/169,502, filed on May 31, 2016, now Pat. No. 9,574,345, which is a continuation of application No. 14/792,104, filed on Jul. 6, 2015, now Pat. No. 9,376,808, which is a continuation of application No. 14/571,158, filed on Dec. 15, 2014, now Pat. No. 9,074,375, which is a division of application No. 14/011,638, filed on Aug. 27, 2013, now Pat. No. 8,939,416.

(60) Provisional application No. 61/805,470, filed on Mar. 26, 2013, provisional application No. 61/694,713, filed on Aug. 29, 2012.

(51) Int. Cl.

| | |
|---|---|
| ***E04F 21/18*** | (2006.01) |
| ***E04B 2/72*** | (2006.01) |
| ***E04F 13/08*** | (2006.01) |
| ***E04F 13/23*** | (2006.01) |
| ***E04B 1/41*** | (2006.01) |
| *E04B 1/38* | (2006.01) |

(52) U.S. Cl.

CPC ..... *E04B 2/967* (2013.01); *E04F 13/083* (2013.01); *E04F 13/23* (2013.01); *E04F 21/1877* (2013.01); *E04B 2001/405* (2013.01)

(56) References Cited

U.S. PATENT DOCUMENTS

| | | | | |
|---|---|---|---|---|
| 5,191,745 | A * | 3/1993 | Story | E04F 13/0812 52/127.8 |
| 5,368,267 | A | 11/1994 | Howard | |
| 5,555,389 | A | 9/1996 | Gilmore | |
| 5,586,811 | A | 12/1996 | Tornero | |
| 6,554,242 | B2 | 4/2003 | Kim | |
| 7,048,244 | B2 | 5/2006 | Hauck | |
| 7,175,146 | B2 | 2/2007 | Kim | |
| 7,270,309 | B2 | 9/2007 | Burns et al. | |
| 7,494,099 | B2 | 2/2009 | Shin | |
| 7,753,332 | B2 | 7/2010 | O'Keene | |
| 7,819,369 | B2 | 10/2010 | LaRossa | |
| 7,891,622 | B1 * | 2/2011 | O'Keene | F16M 11/10 16/358 |
| 8,333,355 | B2 * | 12/2012 | Stifal | F16M 11/10 248/276.1 |
| 8,683,749 | B2 * | 4/2014 | Fontes | F28F 25/00 220/629 |
| 8,746,642 | B2 * | 6/2014 | Molter | F16M 11/10 248/284.1 |
| 8,783,633 | B2 | 7/2014 | Truckor | |
| 8,939,416 | B2 | 1/2015 | Duranleau | |
| 9,074,375 | B2 | 7/2015 | Duranleau | |
| 9,376,808 | B2 | 6/2016 | Duranleau | |
| 2002/0124514 | A1 | 9/2002 | Higgins | |
| 2005/0056749 | A1 | 3/2005 | Simard | |
| 2006/0006296 | A1 | 1/2006 | Morita | |
| 2006/0249633 | A1 | 11/2006 | Korczak et al. | |
| 2007/0007413 | A1 * | 1/2007 | Jung | F16M 11/10 248/284.1 |
| 2007/0199275 | A1 | 8/2007 | Kurz | |
| 2010/0219315 | A1 * | 9/2010 | Muday | F16M 11/10 248/284.1 |
| 2014/0059973 | A1 | 3/2014 | Duranleau | |
| 2015/0096251 | A1 | 4/2015 | McCandless et al. | |
| 2015/0096259 | A1 | 4/2015 | Duranleau | |
| 2015/0308107 | A1 | 10/2015 | Duranleau | |
| 2016/0120309 | A1 * | 5/2016 | Brandt | F16M 11/10 361/679.01 |

FOREIGN PATENT DOCUMENTS

| | | | |
|---|---|---|---|
| GB | 827838 | A | 2/1960 |
| JP | 08-184153 | A | 7/1996 |
| JP | 09-195686 | A | 7/1997 |
| JP | 10-317550 | A | 12/1998 |
| JP | 2005-307656 | A | 11/2005 |
| KR | 10-1002354 | B1 | 12/2010 |

OTHER PUBLICATIONS

Korean Intellectual Property Office, Written Opinion of the International Searching Authority from PCT/US2013/057021, dated Dec. 6, 2013, which is an international application of Applicant Acculign Holdings, Inc. that shares the same priority as this U.S. application.

The State Intellectual Property Office of China, First Office Action from Chinese Application No. 201380045483.0, dated May 30, 2016, which is a foreign application of Applicant Acculign Holdings, Inc. that shares the same priority as this U.S. application.

European Patent Office, extended European search report in EP Application No. 13832190.6, dated Jun. 27, 2016, which is a foreign application of Applicant Acculign Holdings, Inc. that shares the same priority as this U.S. application.

U.S. Patent and Trademark Office, Office action in U.S. Appl. No. 15/437,156, dated Apr. 5, 2017, which is a U.S. continuation application that shares the same priority as this U.S. application.

U.S. Receiving Office, International Search Report and Written Opinion of the International Searching Authority in PCT/US2018/020025, dated May 10, 2018, which is an international application of Applicant Acculign Holdings, Inc.

* cited by examiner

FRONT ADJUSTABLE WALL PANEL MOUNTING DEVICE

CROSS-REFERENCE TO RELATED APPLICATIONS

The present application is a continuation of U.S. Non-Provisional application Ser. No. 15/795,016, filed 26 Oct. 2017, which is a continuation of U.S. Non-Provisional application Ser. No. 15/437,156, filed 20 Feb. 2017, which is a continuation of U.S. Non-Provisional application Ser. No. 15/169,502, filed 31 May 2016, which is a continuation of U.S. Non-Provisional application Ser. No. 14/792,104, filed 6 Jul. 2015, which is a continuation of U.S. Non-Provisional application Ser. No. 14/571,158, filed 15 Dec. 2014, which is a divisional of U.S. Non-Provisional application Ser. No. 14/011,638, filed on 27 Aug. 2013, which claims the benefit of, and priority to, U.S. Provisional Application No. 61/694,713 filed on 29 Aug. 2012; and U.S. Provisional Application No. 61/805,470 filed on 26 Mar. 2013, all incorporated herein by reference.

FIELD OF THE INVENTION

The present invention relates to wall mounting systems. More particularly, the present invention relates to a device for mounting wall panels.

BACKGROUND

A decorative façade wall is often used to enhance the appearance of a building. Many different materials can be used for the façade, such as marble, slate, metal, wood or leather. A decorative façade wall is often made of multiple wall elements or panels. The panels typically have dimensions that are smaller than the dimensions of the entire wall. The smaller dimensions make it easier to transport, store, handle and mount the panels. Also, if a panel is damaged, only that panel need be replaced, rather than the entire wall.

One method of creating a decorative façade wall is to first create a non-decorative wall and then attach decorative panels with adhesive. This method is often used with very small (less than ~1 inch) and light wall panels, such as when making a mosaic. However, it is not very suitable to larger (~6 inch or larger) panels of heavier material, such as metal or stone. Panels held by adhesive will probably not be entirely reliable and falling panels can be a safety hazard. Also, it is unlikely that the surface topography of large panels and the underlying non-decorative wall will be a perfect match, resulting in an uneven surface from one panel to another. With larger panels, this becomes much more noticeable.

A more common method for building a decorative facçade wall with heavier panels is to build a frame wall and then hang the panels on the frame wall. The frame wall is typically made of metal, but may be of other suitable material. It is usually highly desired for aesthetic purposes that the means for attaching the panel to the frame not be readily visible from the front of the wall. Thus, each panel usually has panel mounting hardware attached to the back of the panel that allows it to be mounted to the frame. Metal panels typically have the panel mounting hardware welded or bolted to the back of the panel. Stone panels often have holes drilled part way through the back of the panel and the panel mounting hardware attached by expansion bolts set in the holes.

The panel mounting hardware and/or the frame typically have some means of adjusting the position and/or orientation of each panel. For example, the panel mounting hardware could be threaded bolts set in the panel that engage with threaded nuts in the frame. Selective adjustment of the threaded nuts can be used to adjust the position and/orientation of a panel. However, a technician performing the adjustment in this case must be behind the façade wall. This means that there must be access to the backside of the façade wall for the technician to work. Providing this access is an inefficient use of space in many circumstances. Also, it is difficult for the technician performing the adjustment to determine the effects of the adjustment without seeing how the front side of the panel matches up with the front side of neighboring panels. Either the technician has to run back and forth or a second person is needed to report to the technician the effects of the adjustment. What is needed is a device that mounts a wall panel to a frame and allows adjustment to the position and/or orientation of the panel to be performed from the front of the panel.

BRIEF DESCRIPTION OF THE DRAWINGS

The present invention will be described by way of exemplary embodiments, but not limitations, illustrated in the accompanying drawings in which like references denote similar elements, and in which.

The accompanying drawings, which are incorporated into and constitute a part of this specification, illustrate one or more embodiments of the wall panel mounting system and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference.

First Embodiment

Figure 1:
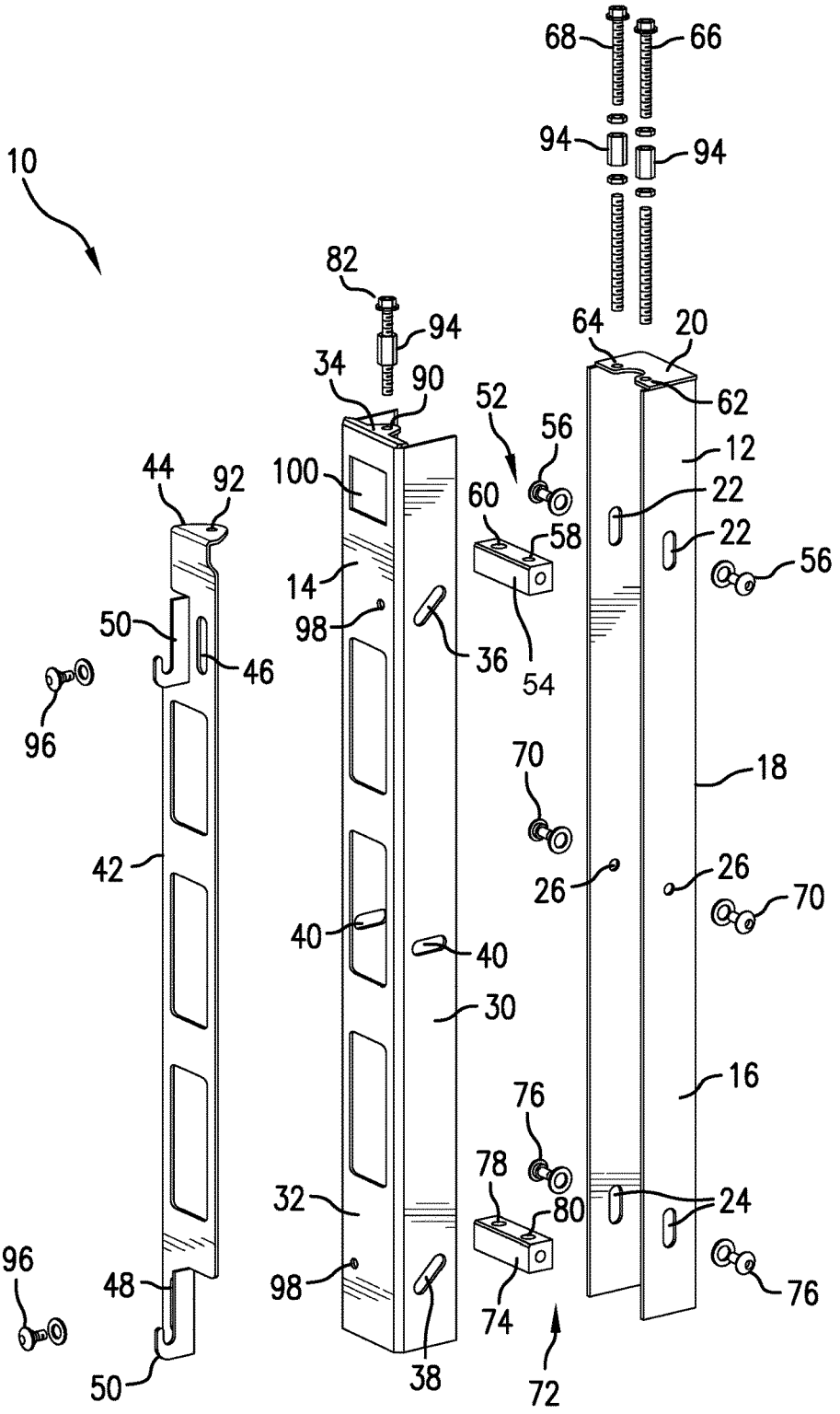
FIG. 1 is an exploded view of a first embodiment of a wall panel mounting device that is adjustable from the front of a wall.
Figure 2:
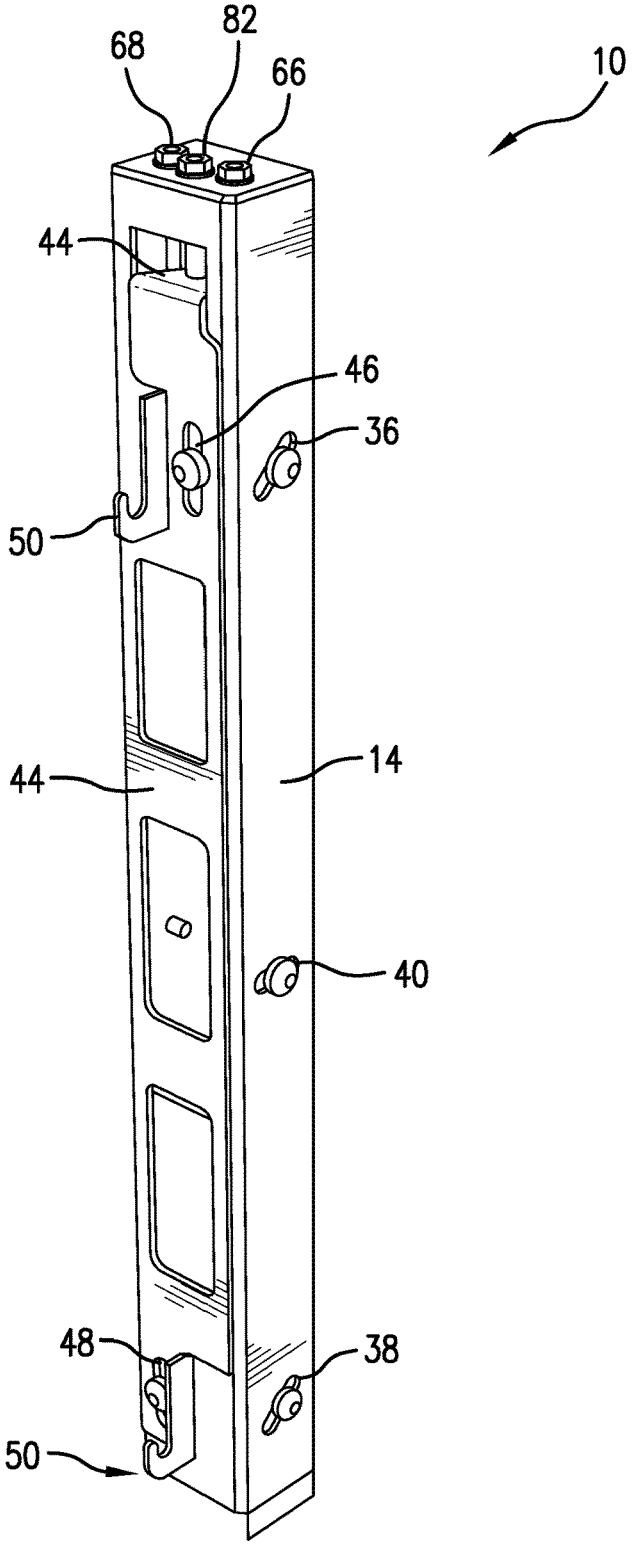
FIG. 2 is an un-exploded view of the first embodiment of the front adjustable wall panel mounting device.
Figure 3:
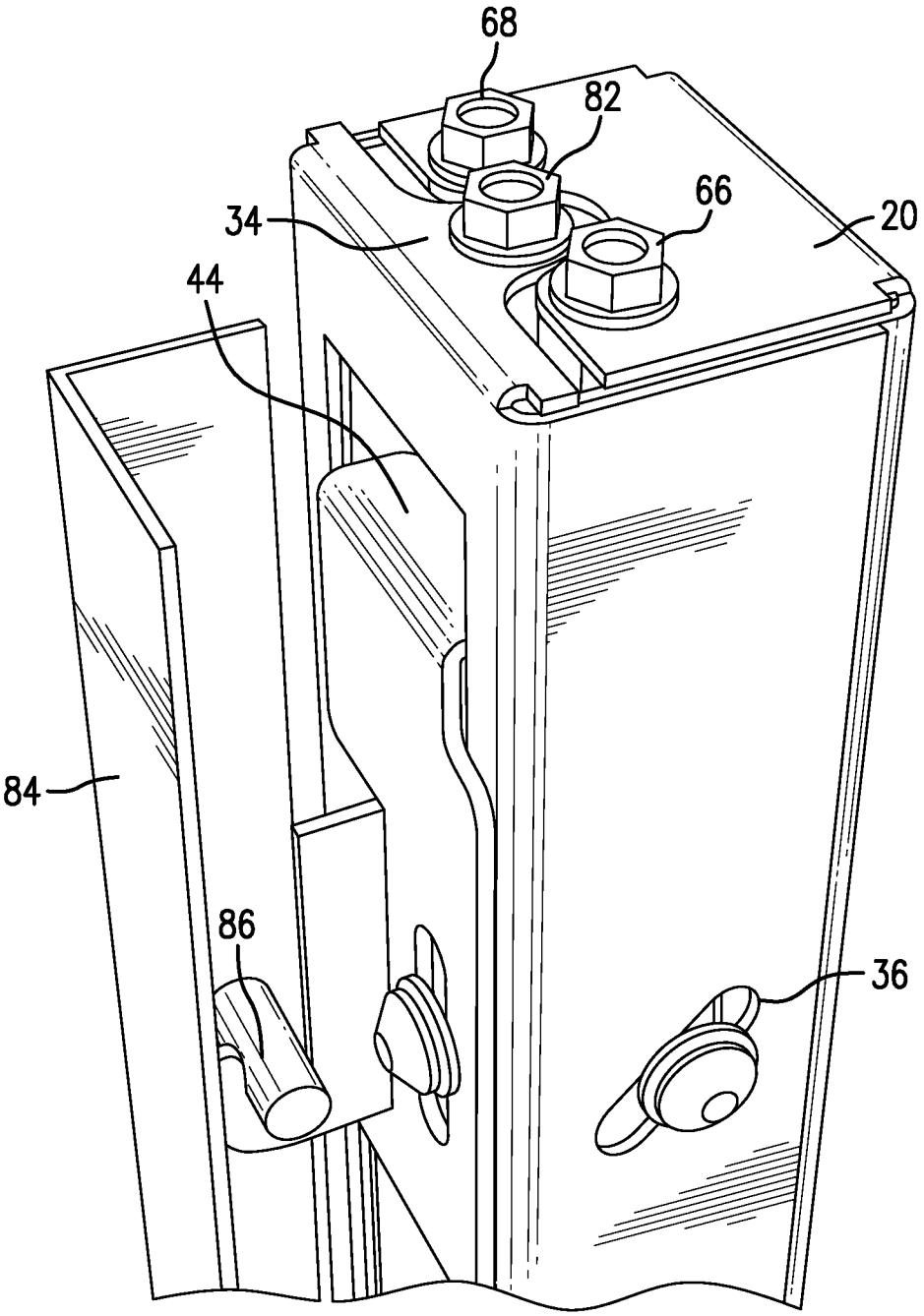
FIG. 3 is a detailed view illustrating how the first embodiment of the front adjustable wall panel mounting device couples with wall panel mounting hardware.

FIGS. 1-6 illustrate construction and use of a first embodiment of a front adjustable wall panel mounting device 10. FIG. 1 is an exploded view of the front adjustable wall panel mounting device 10. FIG. 2 is an un-exploded view of the front adjustable wall panel mounting device 10 from FIG. 1. The front adjustable wall panel mounting device 10 comprises a fixed channel 12, a moving channel 14, and a mounting plate 42. The fixed channel 12 is configured to be coupled to a wall frame (not shown) or similar structure and the mounting plate 42 is configured to be coupled to a wall panel 88 (see FIGS. 5 and 6).

The fixed channel 12 has two fixed channel sides 16, a fixed channel back 18, and a fixed channel end plate 20 at its upper end. The fixed channel 12 has a fixed channel upper slot 22 and a fixed channel lower slot 24 in each of two fixed channel sides 16. The fixed channel upper slot 22 and fixed channel lower slot 24 are parallel to the fixed channel back 18. There is a fixed channel middle hole 26 roughly in the center of each fixed channel side 16. In the first embodiment, the channel middle holes 26 are round, but they may be other shapes in other embodiments. In some embodiments, the fixed channel middle holes 26 are slots that are perpendicular to the fixed channel back 18.

The moving channel 14 has two moving channel sides 30, a moving channel back 32, and a moving channel end cap 34 at its upper end. Each of the two moving channel sides 30 has a moving channel upper slot 36, a moving channel middle slot 40, and a moving channel lower slot 38. The moving channel upper slots 36 are at an angle between zero and ninety degrees relative to moving channel back 32. The moving channel lower slots 38 are at an angle between zero and ninety degrees relative to moving channel back 32. In the embodiment shown in FIGS. 1-2, the angle of the moving channel upper slots 36 and the angle of moving channel lower slots 38 have the same magnitude (45°) and orientation, but in other embodiments may have different magnitudes and/or orientation. The moving channel middle slots 40 are perpendicular to the moving channel back 32.

The moving channel 14 and the fixed channel 12 are configured to nest together. In the embodiment of FIGS. 1-2, the fixed channel 12 is configured to nest within the moving channel 14. In other embodiments, the moving channel 14 is configured to nest within the fixed channel 12.

An upper bar 52 is placed through the fixed channel upper slots 22 and through the moving channel upper slots 36. In the embodiment shown in FIGS. 1-2, the upper bar 52 comprises an upper bar block 54 and two upper bar bolts 56. The upper bar block 54 nests within the fixed channel 12 and the upper bar bolts 56 pass through the fixed channel upper slots 22 and through the moving channel upper slots 36 to couple with the upper bar block 54. In other embodiments, the upper bar 52 is a monolithic piece. The upper bar 52 has an upper bar threaded hole 58 and an upper bar unthreaded hole 60. A first adjustment bolt 66 passes through a first unthreaded hole 62 in the fixed channel end plate 20 and engages with the upper bar threaded hole 58.

At least one middle bar 70 is placed through at least one of the fixed channel middle holes 26 and through at least one of the moving channel middle slots 40. In the embodiment shown in FIGS. 1-2, there are two middle bars 70 in the form of bolts or rivets.

A lower bar 72 is placed through the fixed channel lower slots 24 and through the moving channel lower slots 38. In the embodiment shown in FIGS. 1-2, the lower bar 72 comprises a lower bar block 74 and two lower bar bolts 76. The lower bar block 74 nests within the fixed channel 12 and the lower bar bolts 76 pass through the fixed channel lower slots 24 and through the moving channel lower slots 38 to couple with the lower bar block 74. In other embodiments, the lower bar 72 is a monolithic piece. The lower bar 72 has a lower bar threaded hole 78 and a lower bar unthreaded 72 hole 80. A second adjustment bolt 68 passes through a second unthreaded hole 64 in the fixed channel end plate 20, passes through the upper bar unthreaded hole 60 and engages with the lower bar threaded hole 78. The first adjustment bolt 66 may pass through the lower bar unthreaded hole 80, but in other embodiments, the first adjustment bolt 66 is shorter, does not extend all the way to the lower bar 72, which may not have the lower bar unthreaded hole 80.

First adjustment bolt 66 and second adjustment bolt 68 both have adjustment bolt collars 94, each placed on the respective adjustment bolt under the fixed channel end plate 20 to prevent vertical movement of the first adjustment bolt 66 and second adjustment bolt 68 relative to the fixed channel end plate 20.

The mounting plate 42 has a mounting plate end tab 44 at its upper end. The mounting plate 42 has a mounting plate upper slot 46 and a mounting plate lower slot 48. The mounting plate end tab 44 is configured to insert into a moving channel upper opening 100 of the moving channel 14. The mounting plate 42 is coupled to the moving channel 14 with two mounting plate bolts 96, one passing through the mounting plate upper slot 46 and the other passing through the mounting plate lower slot 48. The moving channel 14 has one or more moving channel back threaded holes 98. The mounting plate bolts 96 engage with moving channel back threaded holes 98, holding the mounting plate 42 against the moving channel 14, but allowing the mounting plate 42 to slide vertically relative to the moving channel 14.

The mounting plate 42 has one or more mounting plate brackets 50 that are configured to couple to any wall panel mounting hardware 84 on the back of a wall panel 88. In the embodiment shown in FIGS. 1-2, the one or more mounting plate brackets 50 are hook shaped to couple with mounting hardware pegs 86. In other embodiments, the one or more mounting plate brackets 50 may have different shapes and different modes of coupling with the wall panel mounting hardware 84.

The moving channel end cap 34 has a moving channel end cap unthreaded hole 90 and the mounting plate end tab 44 has a mounting plate end tab threaded hole 92. A third adjustment bolt 82 passes through a moving channel end cap unthreaded hole 90 and engages with a threaded hole in the mounting plate end tab 44. The third adjusting bolt 82 has an adjustment bolt collar 94 placed on the adjusting bolt under the moving channel end cap 34 to prevent vertical movement of the third adjustment bolt 82 relative to the moving channel end cap 34.

Figure 4:
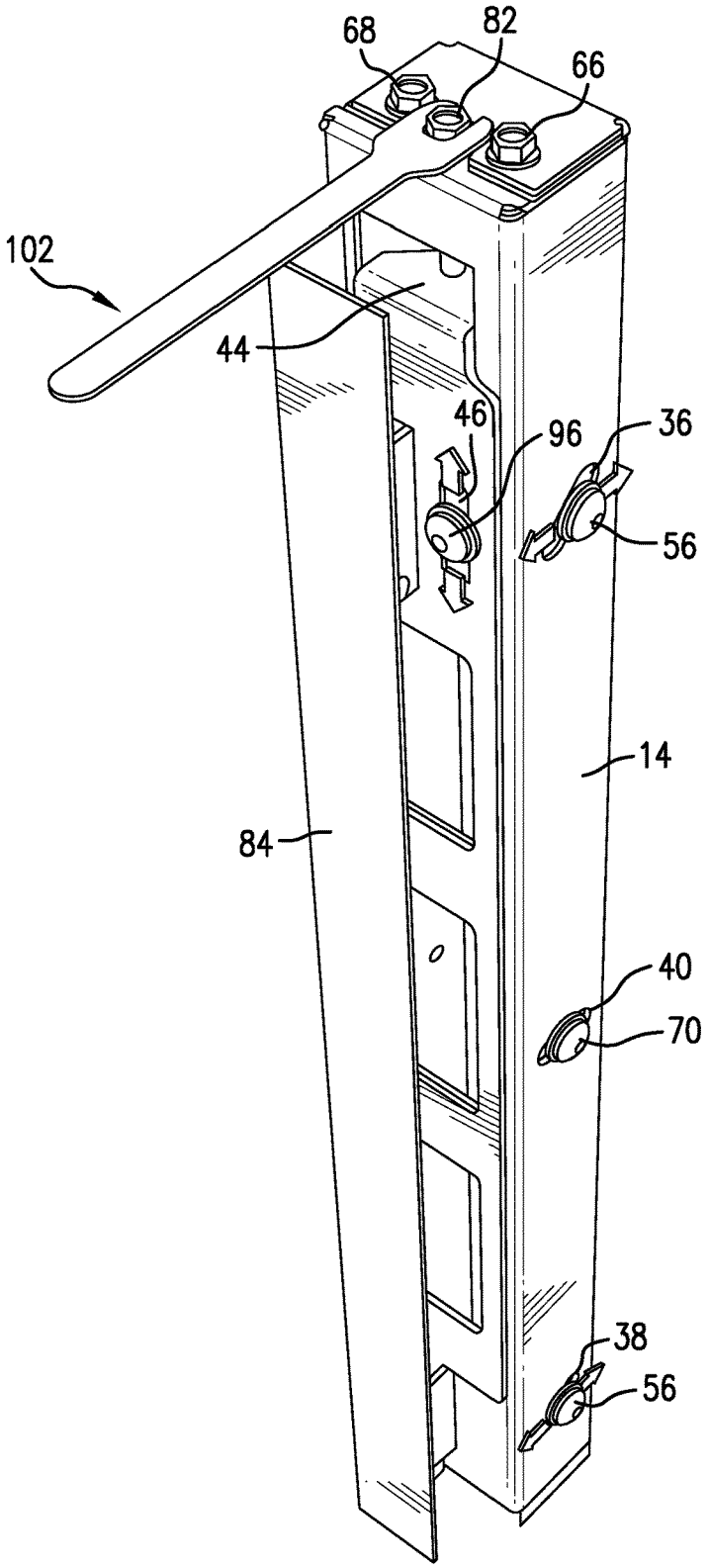
FIG. 4 is a view of the first embodiment of the front adjustable wall panel mounting device coupled with wall panel mounting hardware, illustrating how the tilt, depth, and vertical height of the wall panel mounting hardware can be adjusted.

FIG. 4 is a view of the front adjustable wall panel mounting device 10 coupled with wall panel mounting hardware 84, illustrating how the tilt, depth, and vertical height of the wall panel mounting hardware can be adjusted. The tilt, depth, and vertical height of a wall panel 88 (see FIGS. 5 and 6) coupled to its wall panel mounting hardware 84 and held by the front adjustable wall panel mounting device 10 can be adjusted by turning the adjustment bolts (66, 68, 82). The tilt of the wall panel 88 is adjusted by turning the first or second adjustment bolts (66, 68). Turning the first adjustment bolt 66 causes the upper bar 52 to move up or down, depending on the direction of the threading and the direction the first adjustment bolt 66 is turned. Turning the first adjustment bolt 66 in one direction causes the upper bar 52 to move upwards in the fixed channel upper slots 22 and the moving channel upper slots 36. The middle bars 70 in the moving channel middle slots 40 prevent the moving channel 14 from moving vertically. This causes the moving channel 14 to pivot around the lower bar 72, forcing the upper end of the moving channel 14 to tilt away from the fixed channel 12. Turning the first adjustment bolt 66 in the other direction causes the upper bar 52 to move downwards and causes the upper end of the moving channel 14 to tilt more towards the fixed channel 12.

Turning the second adjustment bolt 68 causes the lower bar 72 to move up or down, depending on the direction of the threading and the direction the second adjustment bolt 68 is turned. Turning the second adjustment bolt 68 in one direction causes the lower bar 72 to move upwards in the fixed channel lower slots 24 and the moving channel lower slots 38. The middle bars 70 in the moving channel middle slots 40 again prevent the moving channel 14 from moving vertically. This causes the moving channel 14 to pivot around the upper bar 52, forcing the lower end of the moving channel 14 to tilt away from the fixed channel 12. Turning the second adjustment bolt 68 in the other direction causes the lower bar 72 to move downwards, and causes the lower end of moving channel 14 to tilt more towards the fixed channel 12.

The channel middle holes 26 and the moving channel middle slots 40 have a vertical height slightly larger than the height of the middle bars 70, or at least a portion of the middle bars 70 that are inserted into the channel middle holes 26 and the moving channel middle slots 40, just large enough to allow the middle bars 70 to move in arcs around either the upper bar 52 or lower bar 72 as the moving channel 14 pivots, but not large enough to allow significant vertical movement of the moving channel 14 relative to the fixed channel 12.

The depth of the wall panel 88 held by the front adjustable wall panel mounting device 10 can be adjusted by turning both the first adjustment bolt 66 and second adjustment bolt 68 such that they move both the upper bar 52 and the lower bar 72 in the same direction and by the same amount. This will change the depth of the wall panel 88, but will keep the amount of tilt the same. However, it will also move the wall panel 88 vertically.

The vertical height of the wall panel 88 can be adjusted by turning the third adjustment bolt 82. Turning the third adjustment bolt 82 causes the mounting plate 42 to move up or down relative to the moving channel 14, depending on the direction of the threading and the direction the third adjustment bolt 82 is turned.

Figure 5:
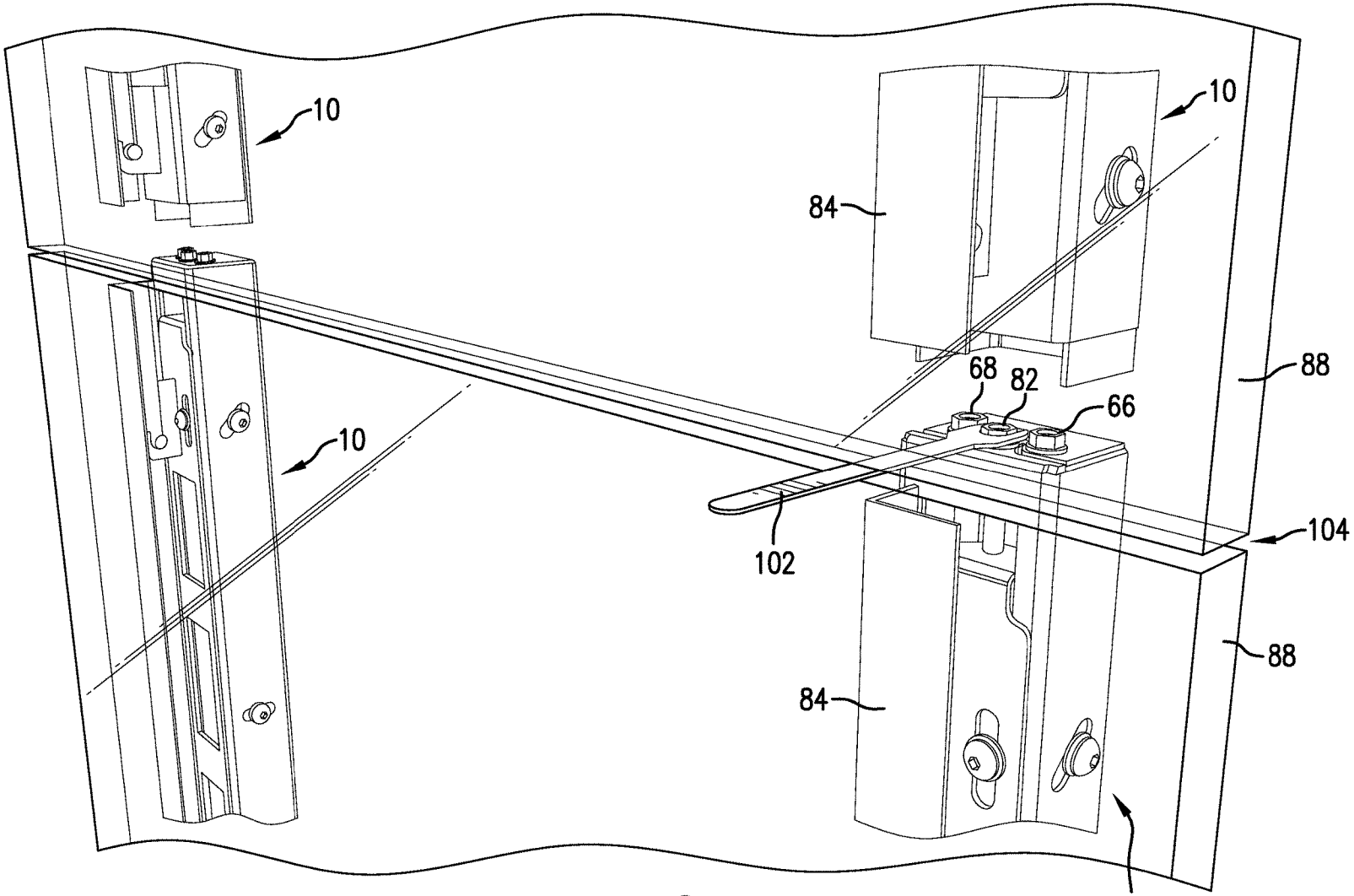
FIG. 5 is a front view of a wall illustrating how the first embodiment of the wall panel mounting device can be adjusted from the front of the wall.
Figure 6:
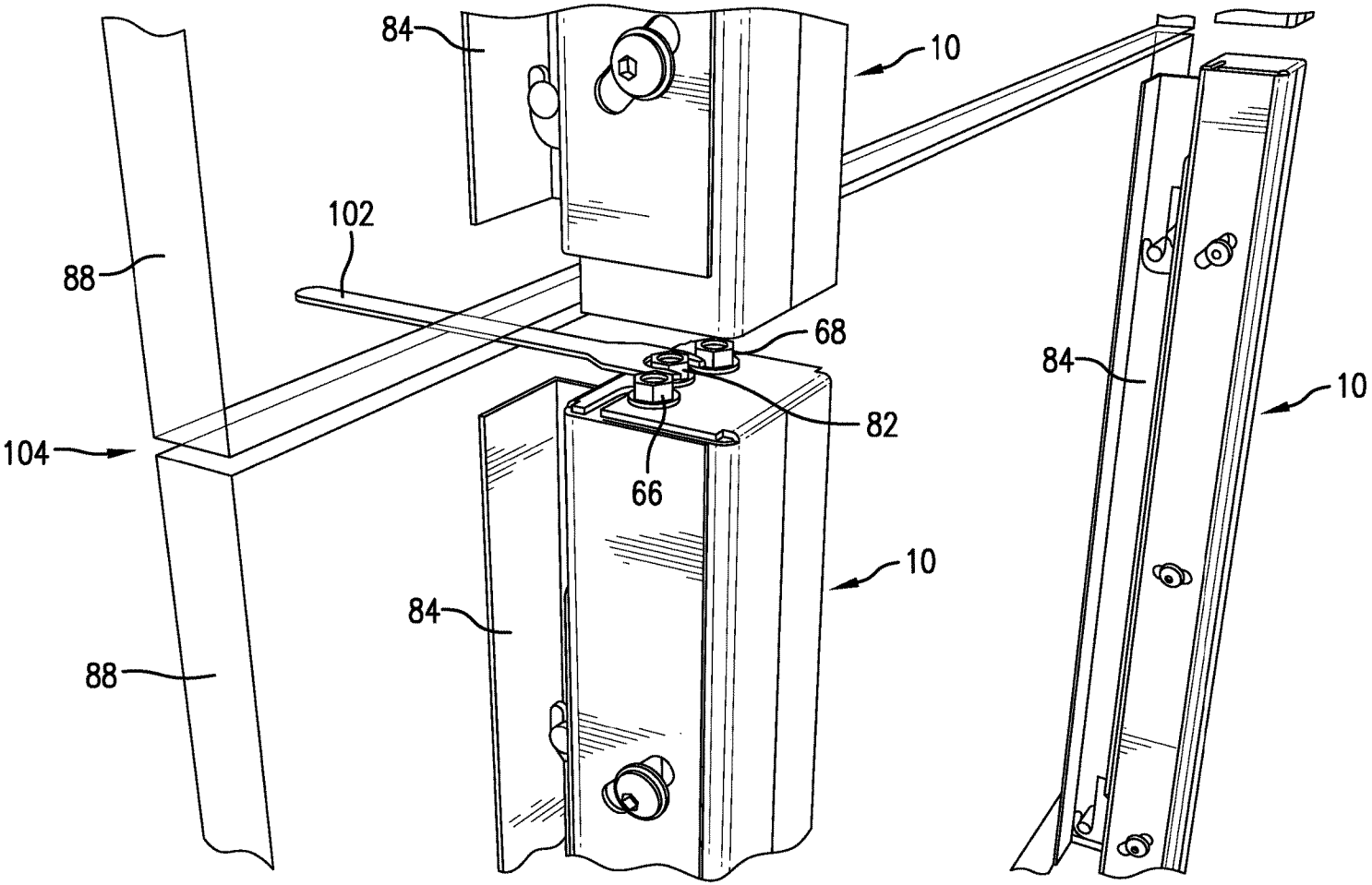
FIG. 6 is a rear view of a wall illustrating how the first embodiment of the wall panel mounting device can be adjusted from the front of the wall.

FIGS. 5 and 6 show how the front adjustable wall panel mounting device 10 can be adjusted from the front of a wall. Wall panels 88 are mounted on adjustable wall panel mounting devices 10 with spacing such that a wall panel gap 104 exists between neighboring wall panels 88. A thin wrench 102 can be inserted into the wall panel gap 104, engage and turn the adjustment bolts (66, 68, and 82). Once the wall panels 88 are adjusted as desired, the wall panel gap 104 can be filled, if desired, with a removable or permanent caulking or filler.

Second Embodiment

Figure 7:
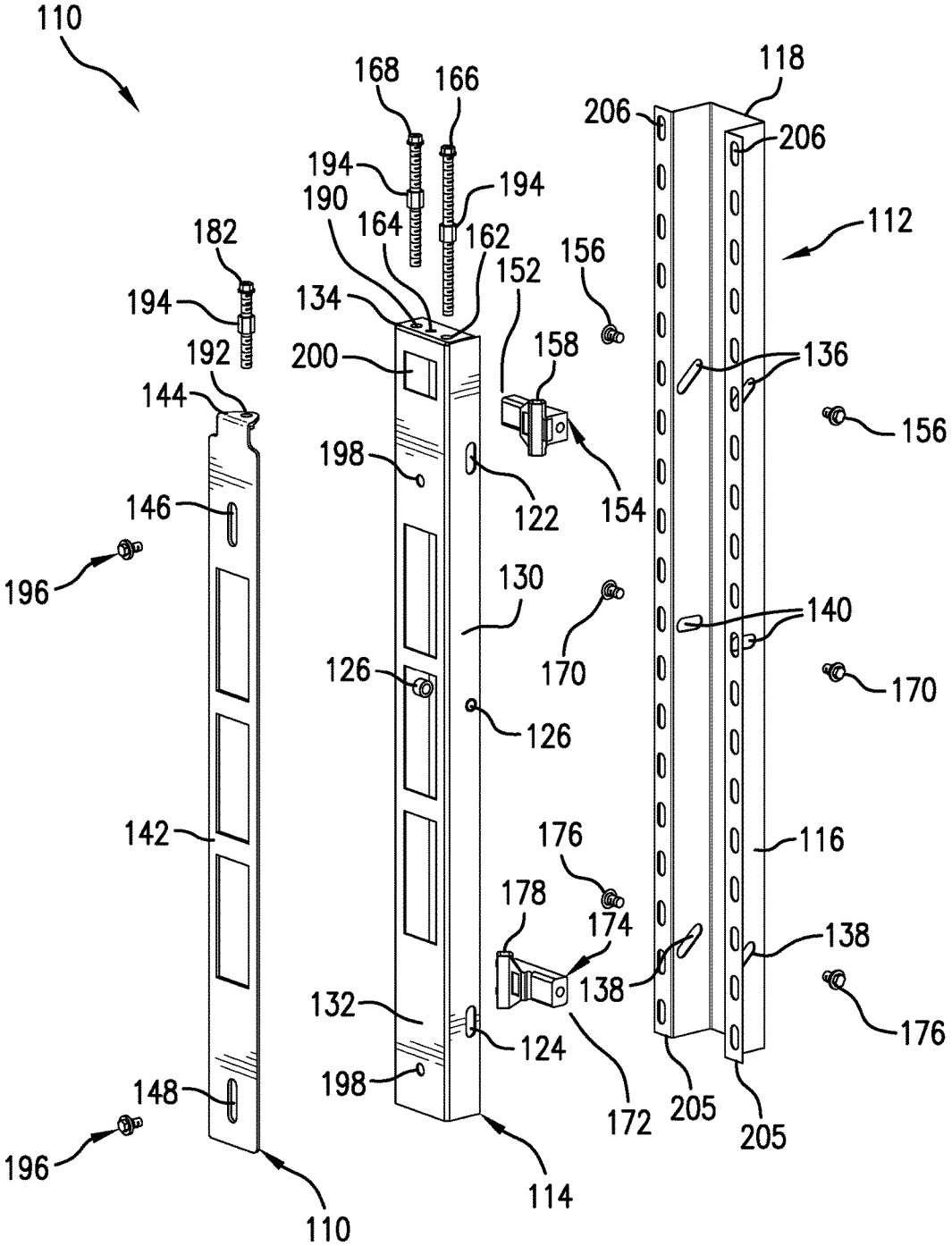
FIG. 7 is an exploded view of a second embodiment of a wall panel mounting device that is adjustable from the front of a wall.

FIG. 7 shows a second embodiment of a front adjustable wall panel mounting device 110. While there are some structural differences, this second embodiment functions in a manner similar to the first embodiment.

The second embodiment front adjustable wall panel mounting device 110 comprises a fixed casing 112, a moving casing 114, and a mounting plate 142. The fixed casing 112 is configured to be fixed to a wall frame (not shown) and the mounting plate 142 is configured to be coupled to a wall panel (not shown).

The moving casing 114 and fixed casing 112 (referred to as channels in the first embodiment) nest in the opposite manner than in the first embodiment (FIGS. 1-6). In the second embodiment, the moving casing 114 fits inside the fixed casing 112 instead of the arrangement of the first embodiment, in which the fixed channel 12 is configured to nest within the moving channel 14 (see FIGS. 1-2). In the second embodiment, the fixed casing 112 has the angled slots instead of the moving channel 14 in the first embodiment.

The fixed casing 112 has two fixed casing sides 116, and a fixed casing back 118. The fixed casing 112 has a fixed casing upper slot 136 and a fixed casing lower slot 138 in each of two fixed casing sides 116. There is a fixed casing middle slot 140 roughly in the center of each fixed casing side 116. The fixed casing 112 has a flange 205 on both sides with slotted holes 206 to facilitate mounting to a wall frame. However, in other embodiments, the flange 205 may be configured differently or the fixed casing 112 may have different structures to facilitate mounting to a wall frame.

The fixed casing upper slots 136 are at an angle between zero and ninety degrees relative to the fixed casing back 118. The fixed casing lower slots 138 are at an angle between zero and ninety degrees relative to the fixed casing back 118. In the embodiment shown in FIG. 7, the angle of the fixed casing upper slots 136 and the angle of the fixed casing lower slots 138 have the same magnitude (45°) and orientation, but in other embodiments may have different magnitudes and/or orientation. The fixed casing middle slots 140 are perpendicular to the fixed casing back 118.

The moving casing 114 has two moving casing sides 130, a moving casing back 132, and a moving casing end plate 134 at its upper end. The moving casing 114 in each of the two moving casing sides 130 has a moving casing upper slot 122, a moving casing middle hole 126 and a moving casing lower slot 124. The moving casing upper slots 122 and the moving casing lower slots 124 are parallel to the moving casing back 132. In the second embodiment, the moving casing middle holes 126 are round, but may be other shapes in other embodiments. In some embodiments, the moving casing middle holes 126 are slots that are perpendicular to the moving casing back 132.

The moving casing 114 and the fixed casing 112 are configured to nest together. In the second embodiment, the fixed casing 112 is configured to nest within the moving casing 114. In other embodiments, the moving casing 114 may be configured to nest within the fixed casing 112.

An upper riser 152 is placed through the fixed casing upper slots 136 and through the moving casing upper slots 122. In the second embodiment, he upper riser 152 comprises an upper riser block 154 and two upper riser bolts 156. In other embodiments, the upper riser 152 may be a monolithic piece. The upper riser block 154 nests within the moving casing 114. The upper riser bolts 156 pass through the fixed casing upper slots 136 and through the moving casing upper slots 122 to couple with the upper riser block 154. The upper riser 152 has an upper riser threaded hole 158, which in the second embodiment is in the upper riser block 154. A first adjustment bolt 166 passes through a first end plate unthreaded hole 162 and engages with the upper riser threaded hole 158.

A lower riser 172 is placed through the fixed casing lower slot 138 and through the moving casing lower slots 124. In the second embodiment, the lower riser 172 comprises a lower riser block 174 and two lower riser bolts 176. The lower riser block 174 nests within the moving casing 114 and the lower riser bolts 176 pass through the fixed casing lower slots 138 and through the moving casing lower slots 124 to couple with the lower riser block 174. In other embodiments, the lower riser 172 is a monolithic piece. The lower riser 172 has a lower riser threaded hole 178. A second adjustment bolt 168 passes through a second end plate unthreaded hole 164, by-passes the upper riser 152 and engages with the lower riser threaded hole 178.

First adjustment bolt 166 and second adjustment bolt 168 both have adjustment bolt collars 194, each placed on the respective adjustment bolt under the moving casing end plate 134 to prevent vertical movement of the first adjustment bolt 66 and second adjustment bolt 68 relative to the moving casing end plate 134.

In the second embodiment, the upper riser block 154 and lower riser block 174 are similar to the upper bar block 54 and lower bar block 74 in the first embodiment except that instead of having an unthreaded hole to pass an adjustment bolt through, in the second embodiment, upper riser block 154 and lower riser block 174 are shaped to allow one of the adjustment bolts to pass by. In the second embodiment, the upper riser block 154 and lower riser block 174 are custom plastic molded components, but in other embodiments may be made of other suitable materials and made by other methods.

One or more middle bars 170 are placed through at least one of the fixed casing middle slots 140 and through at least one of the moving casing middle holes 126. In the second embodiment, there are two middle bars 170 in the form of threaded bolts that couple with threading in the moving casing middle holes 126. In other embodiments, the middle bars 170 are rivets and the moving casing middle holes 126 are unthreaded.

Unlike the first embodiment, the adjustment bolts in the second embodiment do not have adjustment bolt collars under the moving casing end plate 134 to prevent vertical movement of the adjustment bolts relative to the moving casing end plate 134. Instead, gravity pulling down on the various parts of the adjustable wall panel mounting device 110 is relied upon to keep the adjustment bolts from moving vertically relative to the moving casing end plate 134.

The mounting plate 142 has a mounting plate end tab 144 at its upper end. The mounting plate 142 has a mounting plate upper slot 146 and a mounting plate lower slot 148. The mounting plate end tab 144 is configured to insert into a moving casing upper opening 200. The mounting plate 142 is coupled to the moving casing 114 with two mounting plate bolts 196, one passing through the mounting plate upper slot 146 and the other passing through the mounting plate lower slot 148. The mounting plate bolts 96 engage with two moving casing threaded holes 198, holding the mounting plate 142 against the moving casing 114, but allowing the mounting plate 142 to slide vertically relative to the moving casing 114.

Unlike the first embodiment, in the second embodiment, the mounting plate 142 has no hook extruding from it. This is to allow for a variety of cleating options for securing a wall panel to the mounting plate 142.

The moving casing end plate 134 has a third end plate unthreaded hole 190 and the mounting plate end tab 144 has an end tab threaded hole 192. A third adjustment bolt 182 passes through the third end plate unthreaded hole 190 and engages with the end tab threaded hole 192. The third adjusting bolt 182 has an adjustment bolt collar 194 placed on the adjusting bolt under the moving casing end cap 134 to prevent vertical movement of the third adjustment bolt 182 relative to the moving casing end cap 134.

The adjustable wall panel mounting device 110 of the second embodiment can adjust the tilt, depth, and vertical height of a wall panel (not shown) attached to the mounting plate 142. The tilt, depth, and vertical height of the wall panel can be adjusted by turning the adjustment bolts (166, 168, and 182). The tilt of the wall panel is adjusted by turning the first or second adjustment bolts (166, 168). Turning the first adjustment bolt 166 causes the upper riser 152 to move up or down, depending on the direction of the threading and the direction the first adjustment bolt 166 is turned. Turning the first adjustment bolt 166 in one direction causes the upper riser 152 to move upwards in the fixed casing upper slots 136 and the moving casing upper slots 122. The middle bars 170 in the moving casing middle holes 126 prevent the moving casing 114 from moving vertically. This causes the moving casing 114 to pivot around the lower riser 172, forcing the upper end of the moving casing 114 to move toward the fixed casing 112. Turning the first adjustment bolt 166 in the other direction causes the upper riser 152 to move downwards and causes the upper end of the moving casing 114 to move away from the fixed casing 112.

Turning the second adjustment bolt 168 causes the lower riser 172 to move up or down, depending on the direction of the threading and the direction the second adjustment bolt 168 is turned. Turning the second adjustment bolt 168 in one direction causes the lower riser 172 to move upwards in the fixed casing lower slots 138 and the moving casing lower slots 124. The middle bars 170 in the moving casing middle holes 126 again prevent the moving casing 114 from moving vertically. This causes the moving casing 114 to pivot around the upper riser 152, forcing the lower end of the moving casing 114 to move toward the fixed casing 112. Turning the second adjustment bolt 168 in the other direction causes the lower riser 172 to move downwards, and causes the lower end of moving casing 114 to away from the fixed casing 112.

The moving casing middle holes 126 and fixed casing middle slots 140 have a vertical height slightly larger than the height of the middle bars 170, or at least a portion of the middle bars 170 that are inserted into the moving casing middle holes 126 and fixed casing middle slots 140, just large enough to allow the middle bars 170 to move in arcs around either the upper riser 152 or lower riser 172 as the moving casing 114 pivots, but not large enough to allow significant vertical movement of the moving casing 114 relative to the fixed casing 112.

The depth of a wall panel attached to the mounting plate 142 can be adjusted by turning both the first adjustment bolt 166 and adjustment bolt 168 such that they move both the upper riser 152 and the lower riser 172 in the same direction and by the same amount. This will change the depth of the attached wall panel, but will keep the amount of tilt the same. However, it will also move the wall panel vertically.

The vertical height of a wall panel attached to the mounting plate 142 can be adjusted by turning the third adjustment bolt 182. Turning the third adjustment bolt 182 causes the mounting plate 142 to move up or down relative to the moving casing 114, depending on the direction of the threading and the direction the third adjustment bolt 182 is turned.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A device for mounting a wall panel to a wall frame, comprising:

a fixed casing configured to be fixed to the wall frame and defining a channel;

a moving casing including moving casing sides disposed at least partially within the channel;

a wall panel bracket attached to the moving casing, the wall panel bracket configured to hold the wall panel parallel to the moving casing;

an upper adjustment member configured to move in a first direction to cause an upper end of the wall panel to move toward the wall frame while the moving casing remains disposed at least partially within the channel, and to move in a second direction to cause the upper end of the wall panel to move away from the wall frame while the moving casing remains disposed at least partially within the channel; and a lower adjustment member configured to move in a third direction to cause a lower end of the wall panel to move toward the wall frame while the moving casing remains disposed at least partially within the channel, and to move in a fourth direction to cause the lower end of the wall panel to move away from the wall frame while the moving casing remains disposed at least partially within the channel;

wherein the moving casing sides are prevented from extending outside the channel in a direction perpendicular to the wall frame.

2. The device of claim 1, wherein the wall panel bracket is a hook shaped bracket configured to engage the wall panel.

3. The device of claim 1, wherein the moving casing is coupled to the fixed casing by an upper bolt extending through a first pair of complementary apertures in the fixed casing and the moving casing, and a lower bolt extending through a second pair of complementary apertures in the fixed casing and the moving casing.

4. The device of claim 3, wherein the first pair of complementary apertures and the second pair of complementary apertures are all elongated slots.

5. The device of claim 1, wherein a depth of the wall panel relative to the wall frame can be adjusted while keeping an amount of tilt of the wall panel unchanged, by adjusting both the upper and lower adjustment members by an equal amount.

6. The device of claim 5, wherein adjusting both the upper and lower adjustment members by an equal amount will also move the wall panel vertically.

7. The device of claim 1, wherein the upper adjustment member is configured to cause the upper end of the wall panel to move towards and away from the wall frame through threaded engagement with the device.

8. The device of claim 1, wherein the lower adjustment member is configured to cause the lower end of the wall panel to move towards and away from the wall frame through threaded engagement with the device.

9. The device of claim 1, wherein the upper and lower adjustment members can be both adjusted to change a depth of the wall panel relative to the fixed casing, while keeping an amount of tilt of the wall panel unchanged.

10. The device of claim 1, wherein the moving casing sides are prevented by the adjustment members from extending by any amount outside the channel in a direction perpendicular to the wall frame.

11. A device for mounting a wall panel to a wall frame, comprising:

a fixed casing configured to be fixed to the wall frame and defining a channel;

a moving casing including moving casing sides disposed within the channel;

a wall panel attachment member attached to the moving casing, the wall panel attachment member configured to hold the wall panel in a fixed orientation relative to the moving casing;

an upper adjustment member configured to move in a first direction to cause an upper end of the wall panel to move toward the wall frame while the moving casing remains disposed within the channel, and to move in a second direction to cause the upper end of the wall panel to move away from the wall frame while the moving casing remains disposed within the channel; and a lower adjustment member configured to move in a third direction to cause a lower end of the wall panel to move toward the wall frame while the moving casing remains disposed within the channel, and to move in a fourth direction to cause the lower end of the wall panel to move away from the wall frame while the moving casing remains disposed within the channel;

wherein the moving casing sides are prevented from extending outside the channel in a direction perpendicular to the wall frame.

12. The device of claim 11, wherein the wall panel attachment member is a hook shaped bracket configured to engage the wall panel.

13. The device of claim 11, wherein the moving casing is coupled to the fixed casing by an upper attachment member extending through a first pair of complementary apertures in the fixed casing and the moving casing, and a lower attachment member extending through a second pair of complementary apertures in the fixed casing and the moving casing.

14. The device of claim 13, wherein the first pair of complementary apertures and the second pair of complementary apertures are all elongated slots.

15. The device of claim 11, wherein a depth of the wall panel relative to the wall frame can be adjusted while keeping an amount of tilt of the wall panel unchanged, by adjusting both the upper and lower adjustment members by an equal amount.

16. The device of claim 15, wherein adjusting both the upper and lower adjustment members by an equal amount will also move the wall panel vertically.

17. The device of claim 11, wherein the upper adjustment member is configured to cause the upper end of the wall panel to move towards and away from the wall frame through threaded engagement with the moving casing.

18. The device of claim 11, wherein the lower adjustment member is configured to cause the lower end of the wall panel to move towards and away from the wall frame through threaded engagement with the moving casing.

19. The device of claim 11, wherein the upper and lower adjustment members can be both adjusted to change a depth of the wall panel relative to the fixed casing, while keeping an amount of tilt of the wall panel unchanged.

20. The device of claim 11, wherein the moving casing sides are prevented by the adjustment members from extending outside the channel in a direction perpendicular to the wall frame.

* * * * *